US006583375B2

(12) United States Patent
Mahl et al.

(10) Patent No.: US 6,583,375 B2
(45) Date of Patent: Jun. 24, 2003

(54) DRIVE ROD FOR A HIGH-VOLTAGE CIRCUIT-BREAKER

(75) Inventors: Maurice Mahl, Decines (FR); Jean-Marc Willieme, La Mulatiere (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/880,872

(22) Filed: Jun. 15, 2001

(65) Prior Publication Data

US 2002/0003128 A1 Jan. 10, 2002

(30) Foreign Application Priority Data

Jul. 3, 2000 (FR) ..... 00 08618

(51) Int. Cl.[7] ..... H01H 33/18
(52) U.S. Cl. ..... 218/43
(58) Field of Search ..... 218/84, 77, 78, 218/89, 92, 153, 154; 174/177–180

(56) References Cited

U.S. PATENT DOCUMENTS 4,215,255 A * 7/1980 Kimblin et al. ..... 218/136
4,780,581 A * 10/1988 Holmgren et al. ..... 218/59
4,883,930 A 11/1989 Martin ..... 200/148 F

FOREIGN PATENT DOCUMENTS

DE 1 690 121 4/1971 ..... H01H/33/24

OTHER PUBLICATIONS

European Search Report dated Mar. 6, 2001.

* cited by examiner

*Primary Examiner*—Elvin Enad
*Assistant Examiner*—M. Fishman
(74) *Attorney, Agent, or Firm*—Sughrue Mion, PLLC

(57) ABSTRACT

The drive rod for high-voltage switchgear that is insulated with a dielectric gas comprises a segment made of an electrically-insulating material and two metal end pieces fixed to respective ends of the segment, as well as a thermal shield that is made of an electrically-insulating material, that is disposed between the end pieces, and that surrounds the insulating segment while being spaced apart therefrom to define an annular gap serving to be filled with the dielectric gas. In this way, the insulating segment of the rod is protected against thermal attack from electric arcs.

5 Claims, 1 Drawing Sheet

DRIVE ROD FOR A HIGH-VOLTAGE CIRCUIT-BREAKER

The present invention relates to high-voltage circuit-breakers or to other switchgear that is insulated with a dielectric gas, and it relates more particularly to the drive rod for driving the moving contact of a circuit-breaker of a power station, which drive rod is interposed between the moving contact and the control mechanism of the circuit-breaker.

BACKGROUND OF THE INVENTION

The drive rod for driving a moving contact of a high-voltage circuit-breaker in a power station generally comprises a cylindrical segment that can be either solid or hollow, and that is made of an electrically-insulating material, e.g. glass fiber reinforced with resin, and two metal endpieces fixed to respective ends of the insulating segment, one of the endpieces serving to be connected to the moving contact of the circuit-breaker, the other endpiece serving to be connected to the control mechanism.

In known manner, the metal endpiece of the rod that serves to be connected to the moving contact of the circuit-breaker is generally designed in the form of a deflector so as to protect the insulating segment of the rod from the electric arcs that strike between the contacts of the circuit-breaker during the opening operations. The deflector also serves to protect the insulating segment from the hot gases that are removed from behind the moving contact. In spite of this deflector, the insulating segment of the rod is subjected to very considerable thermal attack (burns) that can give rise to an unacceptable reduction it is dielectric strength. To protect the insulating segment from such thermal attack, consideration has already been given to surrounding it with a heat-shrinkable elastomer sheath or with stuck-on strips of PTFE (polytetrafluoroethylene). Unfortunately, with those protection techniques, it is difficult to avoid problems of air being included in the interface between the insulating segment and the protection.

OBJECT AND SUMMARY OF THE INVENTION

An object of the invention is to provide another form of protection for such an insulating rod that is simple to implement and that does not suffer from the above-indicated drawbacks.

To this end, the invention provides a drive rod for high-voltage switchgear that is insulated with a dielectric gas, said drive rod comprising a segment made of an electrically-insulating material and two metal endpieces fixed to respective ends of the segment, wherein a thermal shield made of an electrically-insulating material is disposed between the metal endpieces and surrounds the insulating segment while being spaced apart therefrom to define an annular gap serving to be filled with dielectric gas. With this configuration, even if micro-perforations exist in the shield, there remains a thickness of dielectric gas that is not heated directly by the gas or by electrical arcing, and that thermally protects the insulating segment of the drive rod.

The shield may be made of PTFE, of a ceramic, or of some other insulating material that withstands attack from electrical arcing.

The invention also provides a circuit-breaker insulated with $SF_6$ and equipped with a drive rod of the invention. The annular gap defined by the shield may be filled with the dielectric gas used to insulate the circuit-breaker, or with some other dielectric gas if the annular gap is completely closed.

BRIEF DESCRIPTION OF THE DRAWINGS

The description of an embodiment of the invention is given below with reference to the accompanying drawing, in which.

MORE DETAILED DESCRIPTION

Figure 1:
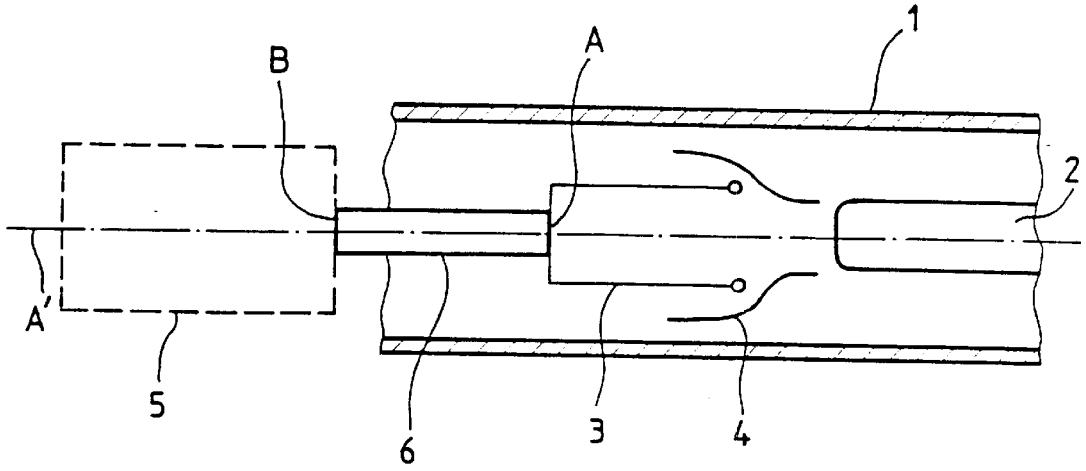
FIG. 1 is a view diagrammatically showing a circuit-breaker with a drive rod of the invention.

As shown in FIG. 1, a power station circuit-breaker conventionally comprises the following in a casing 1 made of an electrically-insulating material and filled with an insulating dielectric gas such as $SF_6$ at a pressure of a few bars: a fixed contact 2, and a moving contact 3 with a gas-blast nozzle 4 for extinguishing electric arcs. The moving contact 3 is moved in the axial direction A' by a control mechanism 5 via a drive rod 6 having one of its ends A connected to the back of the moving contact 3, and its other end B connected to the control mechanism 5.

Figure 2:
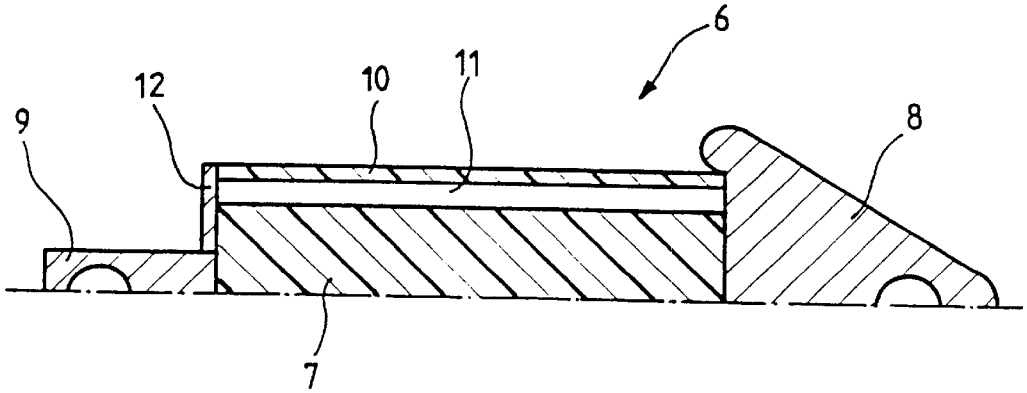
FIG. 2 is an axial half-section view very diagrammatically showing an embodiment of a drive rod of the invention.

As shown in FIG. 2, the drive rod 6 comprises a segment 7 that is made of an electrically-insulating material, that may be either solid or hollow, and that is generally cylindrical. One end of the segment is fixed to a first metal endpiece 8 forming a deflector and constituting the end A of the rod, and the other end of the segment is fixed to a second metal endpiece 9 constituting the end B of the rod. A thermal shield 10, which is tubular in shape in this example, is disposed between the endpieces 8 and 9, and surrounds the insulating segment 7 while being spaced apart therefrom to define an annular gap 11. The shield 10 may be made of PTFE, of a ceramic, or of some other electrically-insulating material that withstands electrical arcing. The shield 10 is held in position around the insulating segment 7 by interfitting with the metal endpiece 8 or by any other fixing means, and by a separate flange plate 12 e.g. mounted on the end B of the rod. In the configuration shown in FIG. 2, the shield 10 thermally protects the segment 7 by means of the thickness of non-heated $SF_6$ that fills the gap 11 between the shield and the segment.

The annular gap defined between the shield 10 and the segment 7 may be open and filled with the dielectric gas used to insulate the circuit-breaker. In a variant, said annular gap may be completely closed in gastight manner and filled with the insulation gas of the circuit-breaker or with some other dielectric gas, such as nitrogen, at a pressure that may be either identical to or different from the pressure of the dielectric gas used to insulate the circuit-breaker. A dielectric gas pressure in the annular gap that is lower than the pressure of the dielectric gas used to insulate the circuit-breaker makes it possible to increase the thermal protection of the segment 7 of the drive rod.

What is claimed is:

1. A drive rod for high-voltage switchgear that is insulated with a dielectric gas, said drive rod comprising:

a segment made of an electrically-insulating material, two metal endpieces fixed to respective ends of the segment, and a thermal shield made of electrically-insulating material disposed in between the endpieces and surrounding the insulating segment while being spaced apart therefrom to define an annular gap.

2. A drive rod according to claim 1, in which the thermal shield is made of PTFE or of a ceramic.

3. A drive rod according to claim 1, in which the annular gap is a completely closed gap.

4. High-voltage switchgear that is insulated with a dielectric gas at a pressure of a few bars, said switchgear including a moving contact connected to a drive rod according to claim 1, in which switchgear the annular gap is filled with said dielectric gas that is used to insulate the switchgear.

5. High-voltage switchgear that is insulated with a dielectric gas at a pressure of a few bars, said switchgear including a moving contact connected to a drive rod according to claim 3, in which switchgear the annular gap is completely closed and is filled with a dielectric gas at a pressure different from the pressure of said dielectric gas that is used to insulate the switchgear.

* * * * *